US009175853B2

(12) United States Patent
Fioriti et al.

(10) Patent No.: US 9,175,853 B2
(45) Date of Patent: Nov. 3, 2015

(54) WATER HEATING SYSTEM WITH OXYGEN SENSOR

(75) Inventors: Gerald A. Fioriti, Rock Tavern, NY (US); Hakan Bjornson, Sparta, NJ (US)

(73) Assignee: Aerco International, Inc., Blauvelt, NY (US)

( * ) Notice: Subject to any disclaimer, the term of this patent is extended or adjusted under 35 U.S.C. 154(b) by 430 days.

(21) Appl. No.: 13/409,935

(22) Filed: Mar. 1, 2012

(65) Prior Publication Data

US 2013/0042822 A1 Feb. 21, 2013

Related U.S. Application Data

(60) Provisional application No. 61/525,044, filed on Aug. 18, 2011.

(51) Int. Cl.

| | |
|---|---|
| ***F23N 5/00*** | (2006.01) |
| ***F24H 1/36*** | (2006.01) |
| ***F24H 9/20*** | (2006.01) |
| ***F23D 14/58*** | (2006.01) |
| ***F24H 1/26*** | (2006.01) |
| ***F24H 1/40*** | (2006.01) |

(52) U.S. Cl.

CPC ..... *F23N 5/006* (2013.01); *F23D 14/58* (2013.01); *F24H 1/26* (2013.01); *F24H 1/36* (2013.01); *F24H 1/40* (2013.01); *F24H 9/2035* (2013.01); *F23D 2203/103* (2013.01); *F23D 2203/1012* (2013.01); *F23N 2041/04* (2013.01); *F23N 2900/05005* (2013.01)

(58) Field of Classification Search

CPC ..... F24H 1/205; G01N 27/4074

See application file for complete search history.

(56) References Cited

U.S. PATENT DOCUMENTS

| | | | | |
|---|---|---|---|---|
| 4,253,426 | A * | 3/1981 | Nishi et al. | 122/17.2 |
| 4,339,318 | A * | 7/1982 | Tanaka et al. | 204/409 |
| 4,358,265 | A | 11/1982 | Tanaka et al. | |

(Continued)

FOREIGN PATENT DOCUMENTS

JP S5656527 5/1981

OTHER PUBLICATIONS

Precision Sports, PSMMS-2d-Bosch LSU 4.9 O2 sensor, May 24, 2011. http://www.precisionsports.ca/en/product/psms-2d--bosch-lsu-49-o2-sensor--laboratory-grade-708.html?manufacturers_id=5& nshop=6120ac49970924b28cdb1018e750d22e.*

(Continued)

*Primary Examiner* — Steven B McAllister
*Assistant Examiner* — Rabeeul Zuberi
(74) *Attorney, Agent, or Firm* — Harris Beach PLLC

(57) ABSTRACT

Water heating system and method including a boiler, a combustion chamber, and a burner housed inside the chamber. A conduit fluidly coupled to the combustion chamber to channel gas into the chamber wherein the burner causes combustion of gas. An oxygen sensor is coupled to the chamber and positioned within the chamber to detect an amount of oxygen in the products of combustion. The oxygen sensor outputs data representative of the amount to a control unit. The control unit controls the feedback control of the water heating system and wherein the combustion of the gas in the chamber is controllable by the control unit at least based on the data. A heat exchanger system is coupled to the chamber to heat water in the heat exchanger with the products. At least one flue coupled to the heat exchanger system to channel products out of the heat exchanger system.

12 Claims, 12 Drawing Sheets

(56) References Cited

U.S. PATENT DOCUMENTS

| | | | | |
|---|---|---|---|---|
| 4,392,813 | A * | 7/1983 | Tanaka et al. | 431/76 |
| 4,597,850 | A * | 7/1986 | Takahasi et al. | 204/426 |
| 4,606,719 | A | 8/1986 | Mori et al. | |
| 4,641,631 | A | 2/1987 | Jatana | |
| 4,994,959 | A * | 2/1991 | Ovenden et al. | 700/33 |
| 5,022,352 | A * | 6/1991 | Osborne et al. | 122/17.2 |
| 5,280,802 | A * | 1/1994 | Comuzie, Jr. | 137/65 |
| 5,338,184 | A | 8/1994 | Dalhuisen | |
| 5,616,021 | A | 4/1997 | Onimaru et al. | |
| 5,881,681 | A * | 3/1999 | Stuart | 122/18.31 |
| 6,036,480 | A * | 3/2000 | Hughes et al. | 431/353 |
| 6,432,288 | B1 * | 8/2002 | Nielsen et al. | 204/424 |
| 6,435,861 | B1 * | 8/2002 | Quick et al. | 431/328 |
| 7,354,244 | B2 * | 4/2008 | Hasbargen et al. | 415/212.1 |
| 2002/0134320 | A1 * | 9/2002 | Valcic et al. | 122/14.31 |
| 2003/0010012 | A1 | 1/2003 | Brandon | |
| 2008/0092754 | A1 * | 4/2008 | Noman | 99/443 C |
| 2009/0308331 | A1 * | 12/2009 | D'Agostini et al. | 122/13.01 |
| 2009/0325112 | A1 * | 12/2009 | Tanaka et al. | 431/18 |

OTHER PUBLICATIONS

ISA/US International Search Report and Written Opinion for corresponding PCT/US2012/027304 dated May 31, 2012 (8 pgs).

European Patent Office, Extended European Search Report for corresponding European Patent Application No. 12823567.8 dated Mar. 5, 2015 (6 pgs).

* cited by examiner

WATER HEATING SYSTEM WITH OXYGEN SENSOR

CROSS REFERENCE TO RELATED APPLICATION

Reference is made to and this application claims priority from and the benefit of U.S. Provisional Application Ser. No. 61/525,044, filed Aug. 18, 2011, entitled "WATER HEATING SYSTEM WITH AN OXYGEN SENSOR", which application is incorporated herein in its entirety by reference.

FIELD OF THE INVENTION

This disclosure relates generally to a water heating system and a method of controlling the water heating system.

BACKGROUND OF THE INVENTION

In residential and commercial construction, a water heating system is necessary for heating water. However, water heating systems can be complex and inefficient. Known heating systems monitor characteristics about the water heating system to enhance the water heating system. Such characteristics may include monitoring the water temperature exiting the system, monitoring the rate at which gas enters the system, monitoring the amount of energy consumed in heating water, and the like. These heating systems are able to use such information to alter variables of the heating system in order to optimize the output of the system.

One characteristic that can be helpful in optimizing a heating system is the amount of oxygen in products of combustion in the heating system. Some heating systems are able to monitor the amount of oxygen in the products of combustion with non-dispersive Infrared (NDIR) sensors. NDIR sensors are spectroscopic devices often used for gas analysis. However, NDIR sensors are expensive and can cost approximately $30,000. Unfortunately, known heating systems have been unable to monitor the amount of oxygen combusted in the products of combustion effectively and in a cost efficient manner.

SUMMARY OF THE INVENTION

There exists a need in the industry for a more efficient water heating system and method of operating the same.

According to one embodiment of the disclosed subject matter, a water heating system includes: a boiler, including a combustion chamber, and a burner housed inside the combustion chamber. At least one conduit is fluidly coupled to the combustion chamber to channel gas into the combustion chamber. The burner causes combustion of gas to create products of combustion. An oxygen sensor is coupled to the combustion chamber and positioned within the combustion chamber to detect an amount of oxygen remaining in the products of combustion. The oxygen sensor outputs data representative of the amount of oxygen in the products of combustion. A control unit controls the feedback control of the water heating system, wherein the control unit receives the data from the oxygen sensor and wherein the combustion of the gas in the combustion chamber is controllable by the control unit at least based on the data. A heat exchanger system is coupled to the combustion chamber to heat water in the heat exchanger with the products of combustion. At least one flue is coupled to the heat exchanger system to channel the products of combustion out of the heat exchanger system.

According to a further aspect of the disclosed subject matter, there is provided a method of controlling a water heating system, comprising channeling gas through at least one conduit fluidly coupled to a combustion chamber of a boiler and combusting the gas with a burner housed inside the combustion chamber. An amount of oxygen in the combustion of gas is determined by an oxygen sensor coupled to the combustion chamber and positioned within the combustion chamber adjacent the burner. Data representative of the amount of oxygen in the products of combustion is output to a control unit of the boiler. The feedback control of the water heating system is controlled at least based on the amount of oxygen in the products of combustion. The products of combustion are directed from the combustion chamber to a heat exchanger system coupled to the combustion chamber. The products of combustion in the heat exchanger system heat water in the heat exchanger system. The products of combustion are directed out of the heat exchanger system through a flue.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
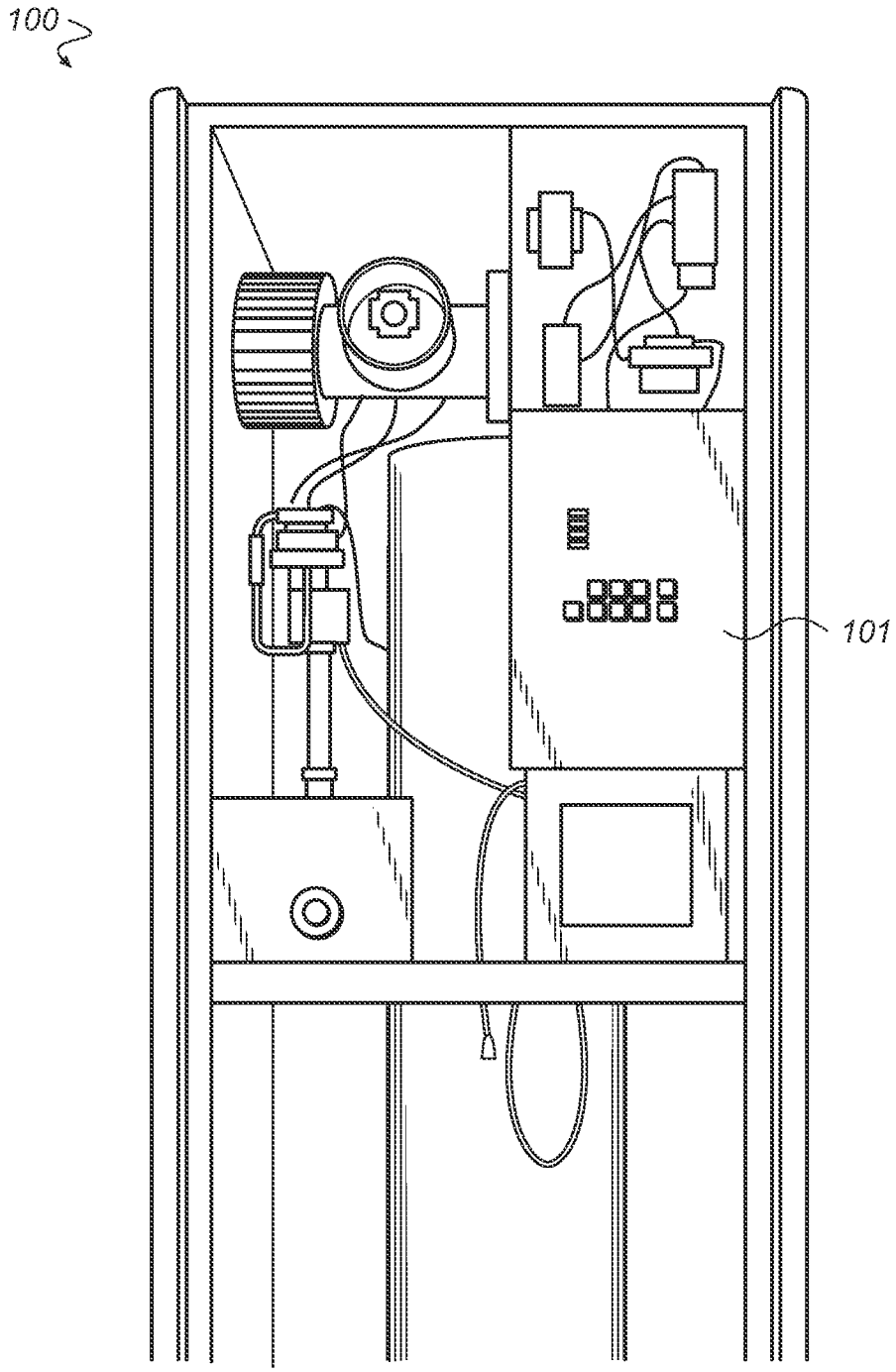
FIG. 1 is perspective view of a water heating system, according to an embodiment of the disclosed subject matter.

FIG. 1 shows an embodiment of a water heating system 100. The water heating system includes a control unit 101 for feedback control of the water heating system 100. The control unit 101 can include a computer or the like. The control unit can control the coordination and operation of all components in the water heating system. In one embodiment, the control unit uses proportional-integral-derivative (PID) control to optimize the water heating system including oxygen control. The disclosed subject matter further includes other suitable control systems.

Figure 2:
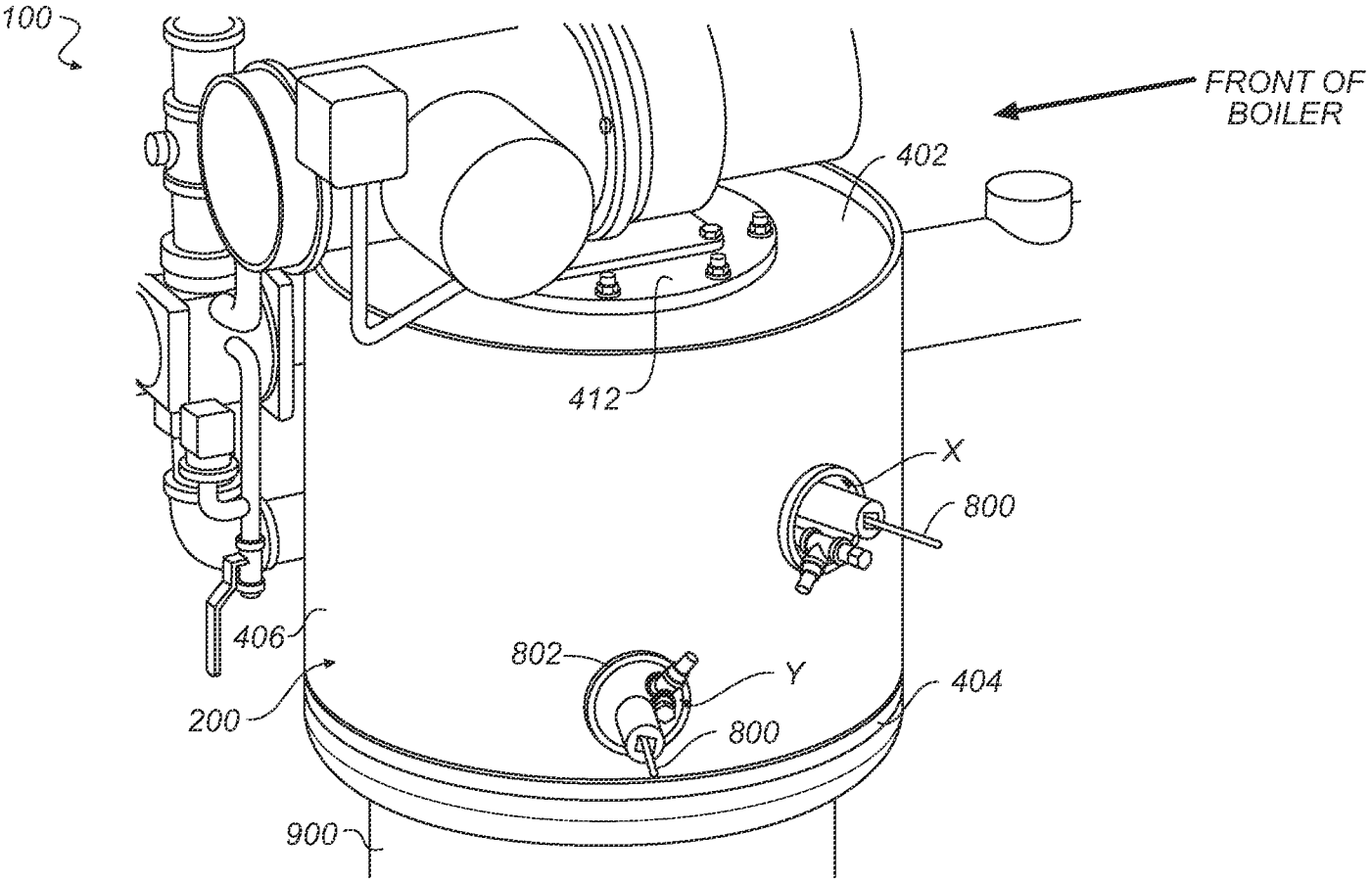
FIG. 2 is a schematic perspective view of the top half of a water heating system, according to an embodiment of the disclosed subject matter.

Referring to FIG. 2, the water heating system 100 includes a boiler 200, such as but not limited to a condensing boiler, which can be controlled by the control unit 101. The boiler 200 can be a variety of configurations including vertical cylindrical, horizontal cylindrical, and rectangular. FIG. 2 depicts an example of a vertical cylindrical boiler. The boilers can vary in power, for example, from approximately 50,000 to 6.2 million BTU/hr boilers. Further, for example, but not limited to, the boilers can have 20:1 and 15:1 turndown ratios. A turndown ratio of 20:1 indicates the boiler can operate between 5% and 100% of maximum output (e.g., 1/20), and a turndown ratio of 15:1 indicates the boiler can operate between 6.7% and 100% of maximum output. The boiler 200 can include a plurality of suitable materials including, but not limited to, cast iron, cast aluminum, and stainless steel. One exemplary vertical cylindrical boiler 200 is the BENCHMARK® boiler manufactured by Aerco® International, Inc. of Blauvelt, N.Y. Further examples of boilers can be found in U.S. Pat. Nos. 5,881,681; 6,435,862; 4,852,524; 4,519,422; 4,346,759; and 4,305,547; all of which are incorporated herein in their entirety.

Figure 3:
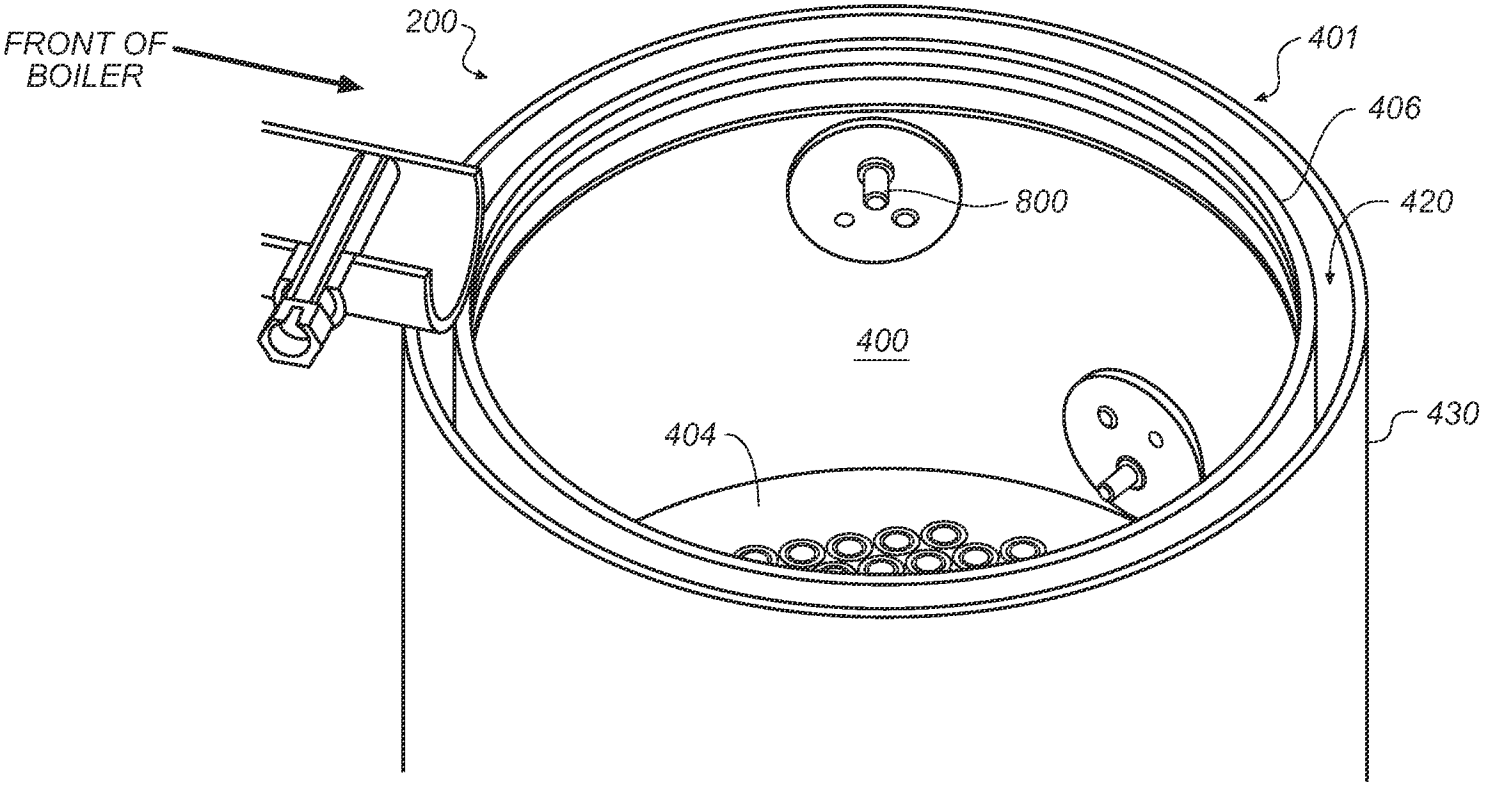
FIG. 3 is a perspective view of the interior of a combustion chamber of an embodiment of a water heating system, according to an embodiment of the disclosed subject matter.
Figure 4:
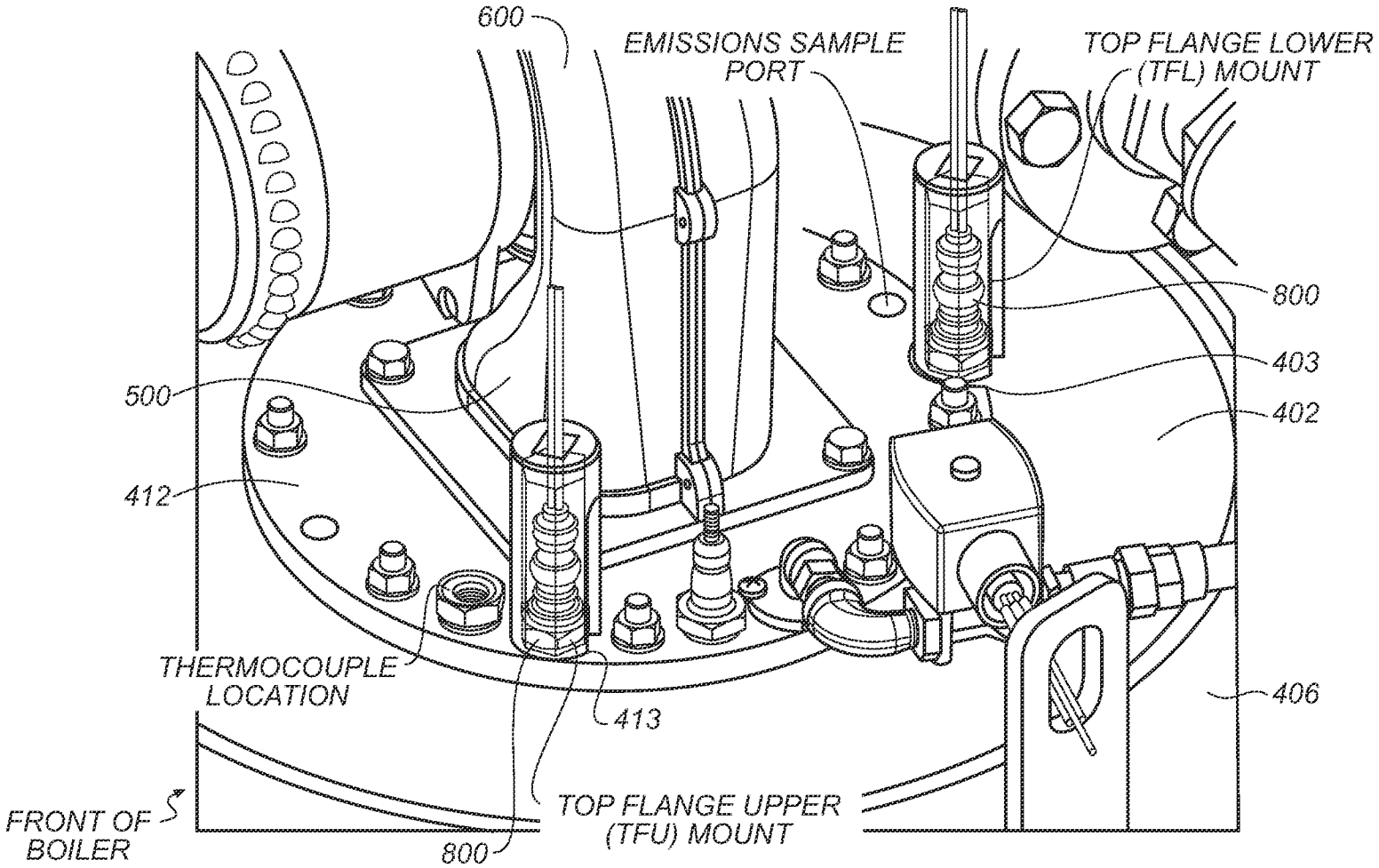
FIG. 4 is a perspective view of the top of a water heating system, according to an embodiment of the disclosed subject matter.

The boiler 200 has a plurality of components including a combustion chamber 400, as depicted in FIG. 3. The combustion chamber 400 comprises an enclosed housing 401 including a first plate 402 (FIG. 2), a second plate 404 at a distance to the first plate, and at least one sidewall 406 to couple the first plate 402 with the second plate 404. The second plate 404 can include a tube sheet as depicted in FIG. 3. A top plate 412 can be additionally positioned on the first plate 402, exterior to the combustion chamber 400, as depicted in FIG. 4. The top plate 412 and the first plate 402 can define a plurality of recesses to couple different devices to the boiler for fluid communication with the combustion chamber, as further discussed herein. Such devices can be insertable into the recesses and sealed.

The combustion chamber 400 can be a variety of configurations including, but not limited to, cylindrical and rectangular. When the combustion chamber is embodied as cylindrical, the chamber has a curved sidewall 406 coupled to the first plate 402 and the second plate 404. When the combustion chamber is embodied as rectangular, the chamber has four sidewalls coupled to the first plate and the second plate.

The combustion chamber 400 can include a plurality of suitable materials including, but not limited to, carbon steel, stainless steel, or non-metallic refractory materials. The top plate 412 can include, for example, carbon steel or stainless steel.

The boiler 200 can further include a water jacket 420 and an external housing 430 that houses the combustion chamber 400. The water jacket 420 can be positioned between the external housing 430 and the combustion chamber 400, as depicted in FIG. 3, and can provide cooling for the boiler, heating of the make up water, or both.

The combustion chamber 400 receives gas and is designed to withstand the combustion of gases. The gas can include a plurality of suitable gases. For example, the gas can include a mixture of air and compressed natural gas (CNG). The chemical composition of the CNG can vary and many suitable compositions are contemplated herein. In one embodiment, the CNG comprises methane, ethane, propane, butane, pentane, nitrogen (N2), and carbon dioxide (CO2).

Figure 12:
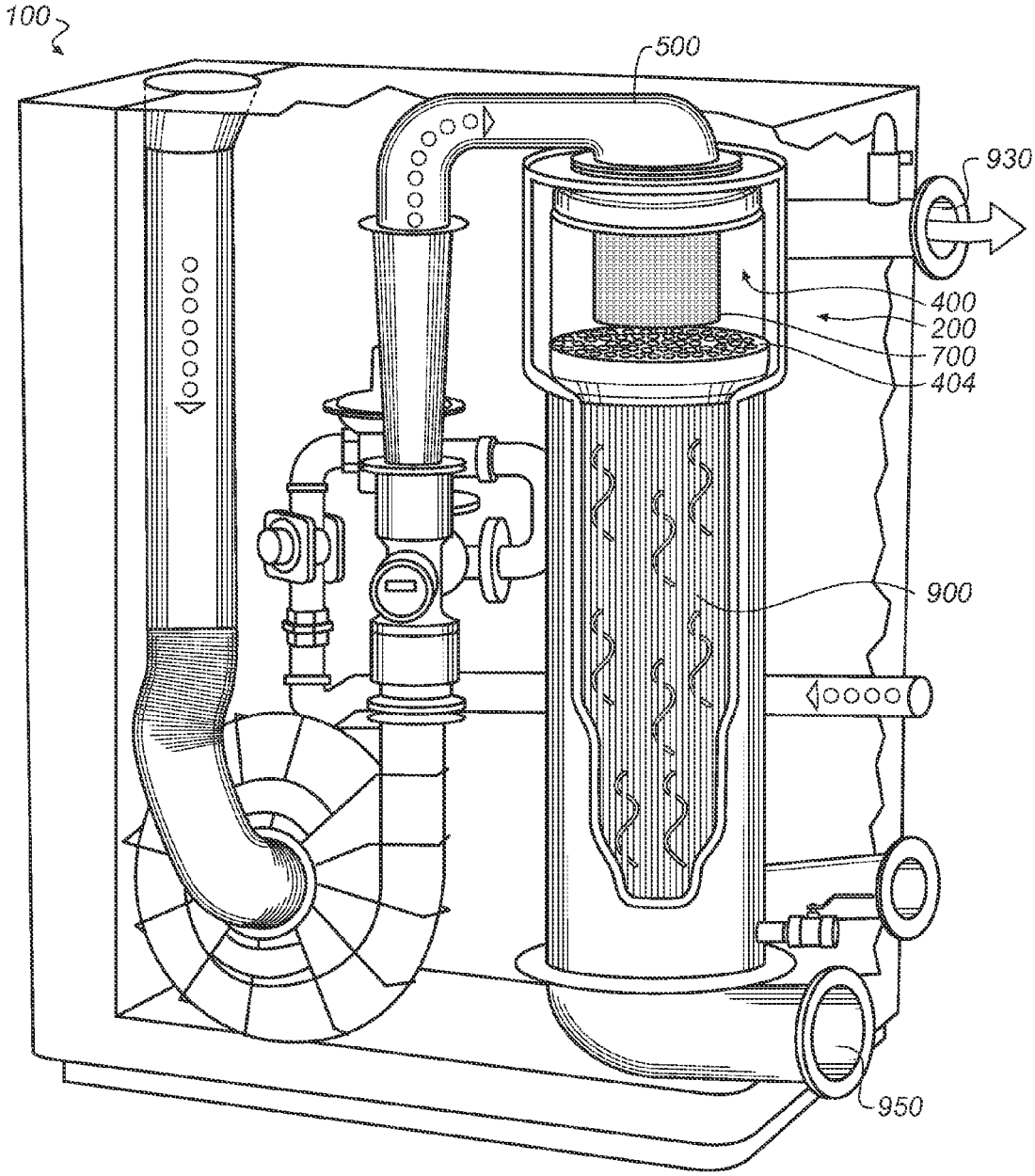
FIG. 12 provides a perspective view of a water heating system, according to an embodiment of the disclosed subject matter.
Figure 13:
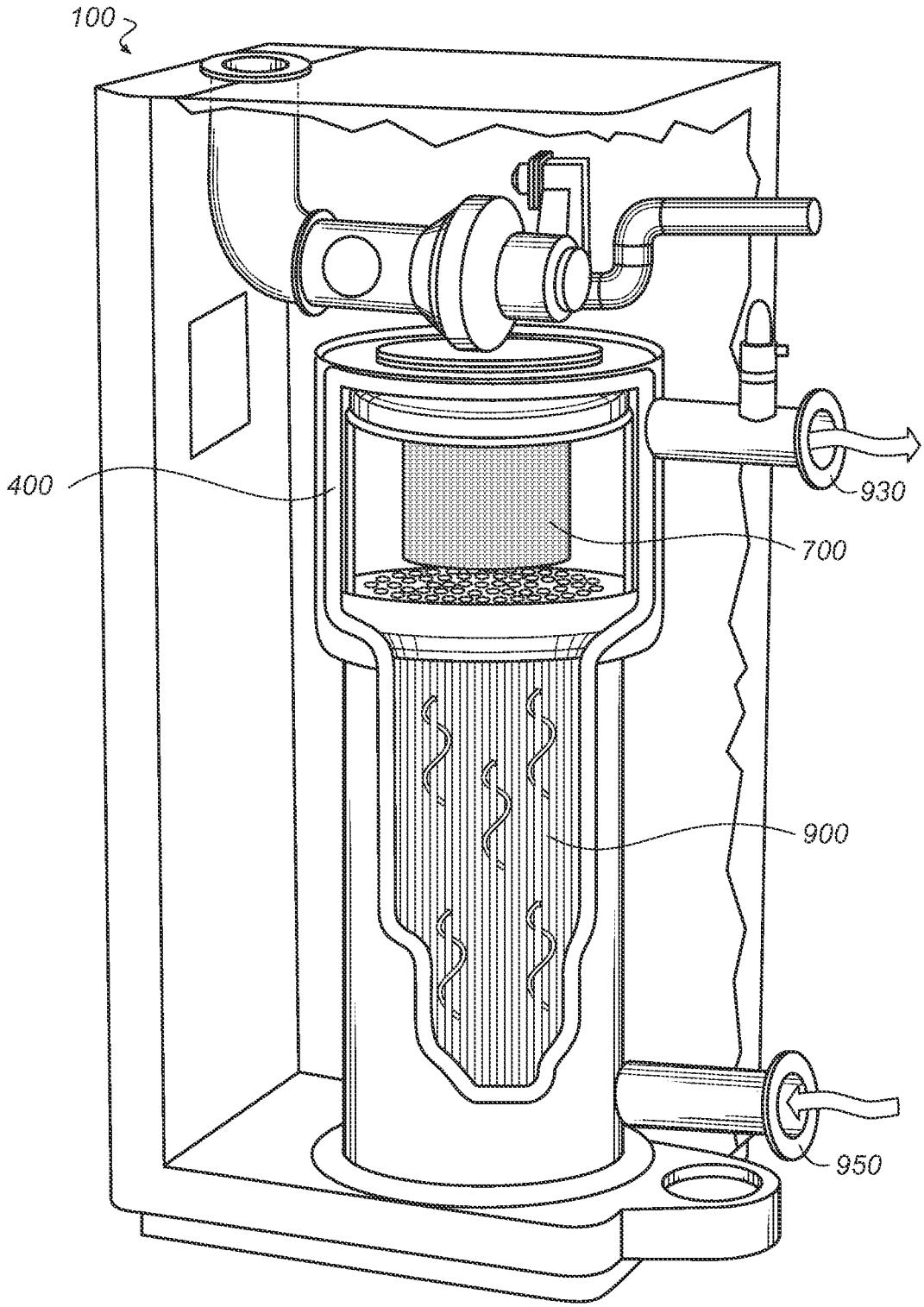
FIG. 13 provides a perspective view of a water heating system, according to another embodiment of the disclosed subject matter.

The gas which is channeled into the combustion chamber 400 can be premixed with air. In other embodiments, the gas and air are channeled into the combustion chamber separately, as depicted in FIGS. 12 and 13. For example, an air conduit and a gas conduit can be separately coupled to the combustion chamber to deliver air and gas, respectively. In a further embodiment, the air conduit and the gas conduit can be channeled to a mixing chamber and then together channeled into the combustion chamber.

The control unit 101 (FIG. 1) can monitor the air-to-gas ratio to maintain desired levels of oxygen for the combustion process. A plurality of devices and methods can be used to control the air-to-gas mixture ratio and are contemplated herein. In one example, an air valve, air/gas valve, and/or gas valve can furthermore be provided to allow the air and gas to channel into the combustion chamber 400. The control unit 101 can control the respective valves to control the air-to-gas ratio. In one embodiment, the control unit 101 controls the respective valves based on data obtained from an oxygen sensor, as further discussed below.

TABLE 1

| | |
|---|---|
| Nominal Air-to-gas Ratio | 16.43 |
| Hydrogen to Carbon Ratio (H:C) | 3.896 |
| Oxygen to Carbon Ratio (O:C) | 0.0216 |
| Nitrogen to Carbon Ratio (N:C) | 0.0238 |

The air-to-gas ratio can vary based on desired use. Table 1 illustrates one embodiment.

The boiler 200 further includes at least one conduit 500 fluidly coupled to the combustion chamber 400, as depicted in FIG. 4, to channel the gas into the combustion chamber. The conduit 500 can be coupled to the combustion chamber via a recess defined in the first plate 402 and/or top plate 412 of the combustion chamber 400.

The boiler further includes a blower device 600 that blows the gas into the at least one conduit 500. The blower device 600 can vary the rate in which the gas enters the combustion chamber 400. The blower device 600 can include a variable speed blower or a constant speed blower. Further, the blower device 600 can alter the percentages of the composition of the gas that enters the combustion chamber. The blower device 600 is controllable and monitorable by the control unit 101 (FIG. 1). The blower device 600 is capable of sending and receiving outputs to the control unit. In another embodiment (not illustrated), the blower device can be separately controlled by a blower device driver. The blower device can create a high pressure at the relative top of the combustion chamber which further forces the gas through the combustion chamber away from the conduit.

Figure 5:
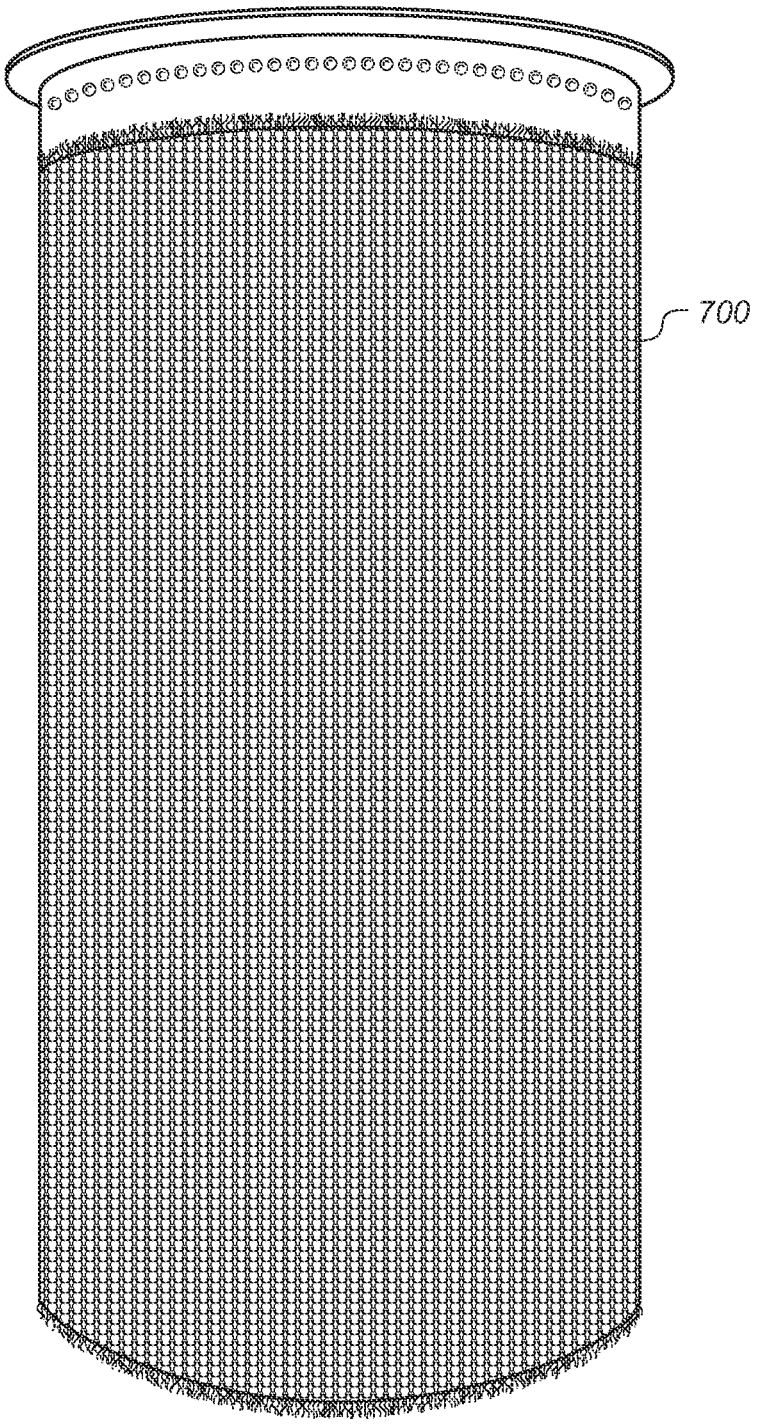
FIG. 5 is a perspective view of a cylindrical short flame low nitrogen oxide (NOx) mesh burner, according to an embodiment of the disclosed subject matter.
Figure 6:
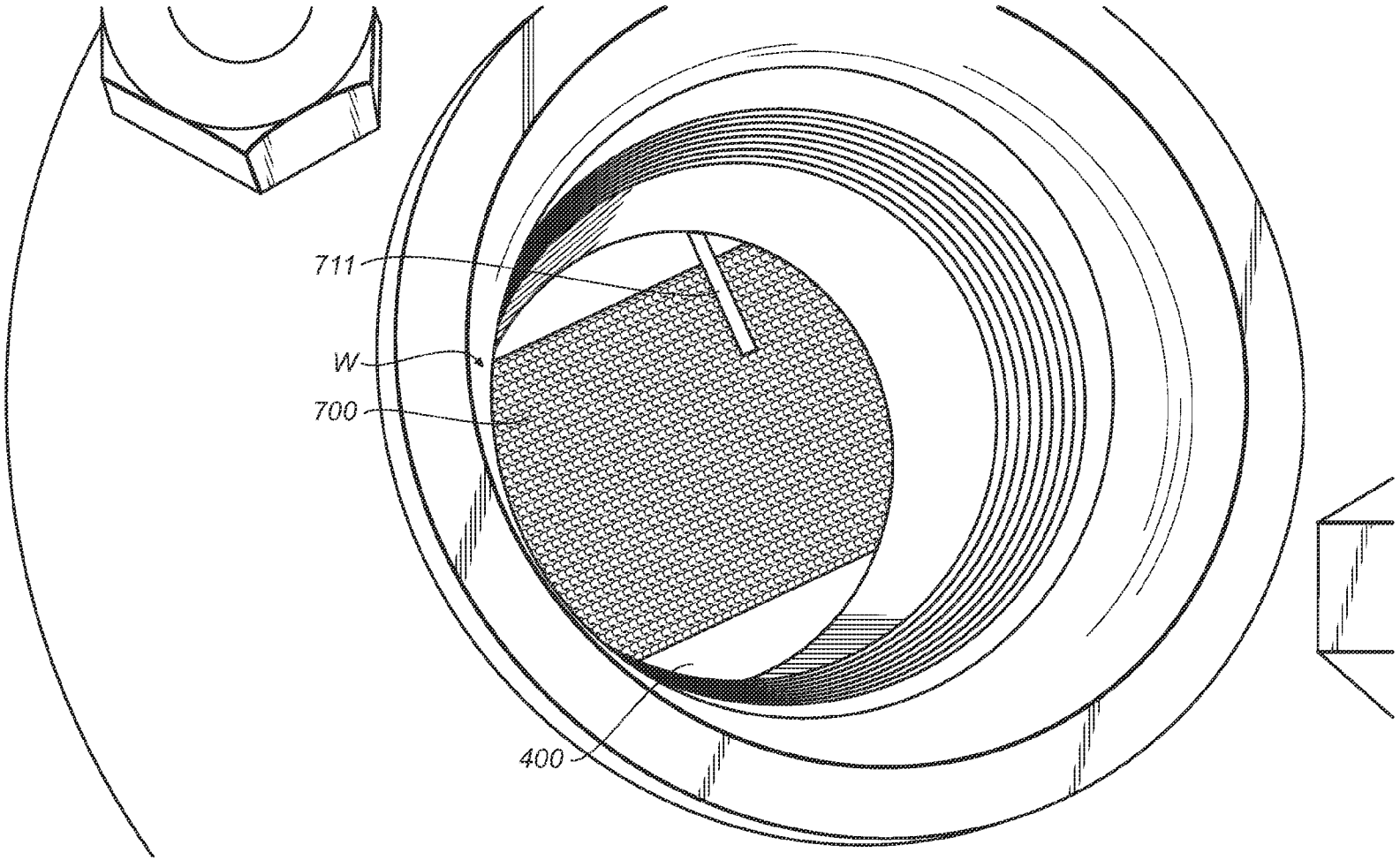
FIG. 6 provides a perspective view of the inside of a combustion chamber through a view window, according to an embodiment of the disclosed subject matter.

A burner 700 is further provided inside the combustion chamber 400 to facilitate the combustion of gas that enters the combustion chamber. The burner 700 can include a variety of suitable configurations. In one embodiment, the burner 700 comprises a cylindrical short flame low nitrogen oxide (NOx) mesh burner, as illustrated in FIG. 5. The burner 700 can be coupled to an interior of the first plate 402 within the combustion chamber 400. FIG. 6 provides a perspective view of the inside of the combustion chamber 400 through a view window W. Further depicted in FIG. 6 is a cylindrical short flame low nitrogen oxide (NOx) mesh burner 700 coupled to the first plate 402. In another embodiment of the disclosed subject matter, the burner comprises different configurations including, but not limited to, a flat burner.

Figure 7:
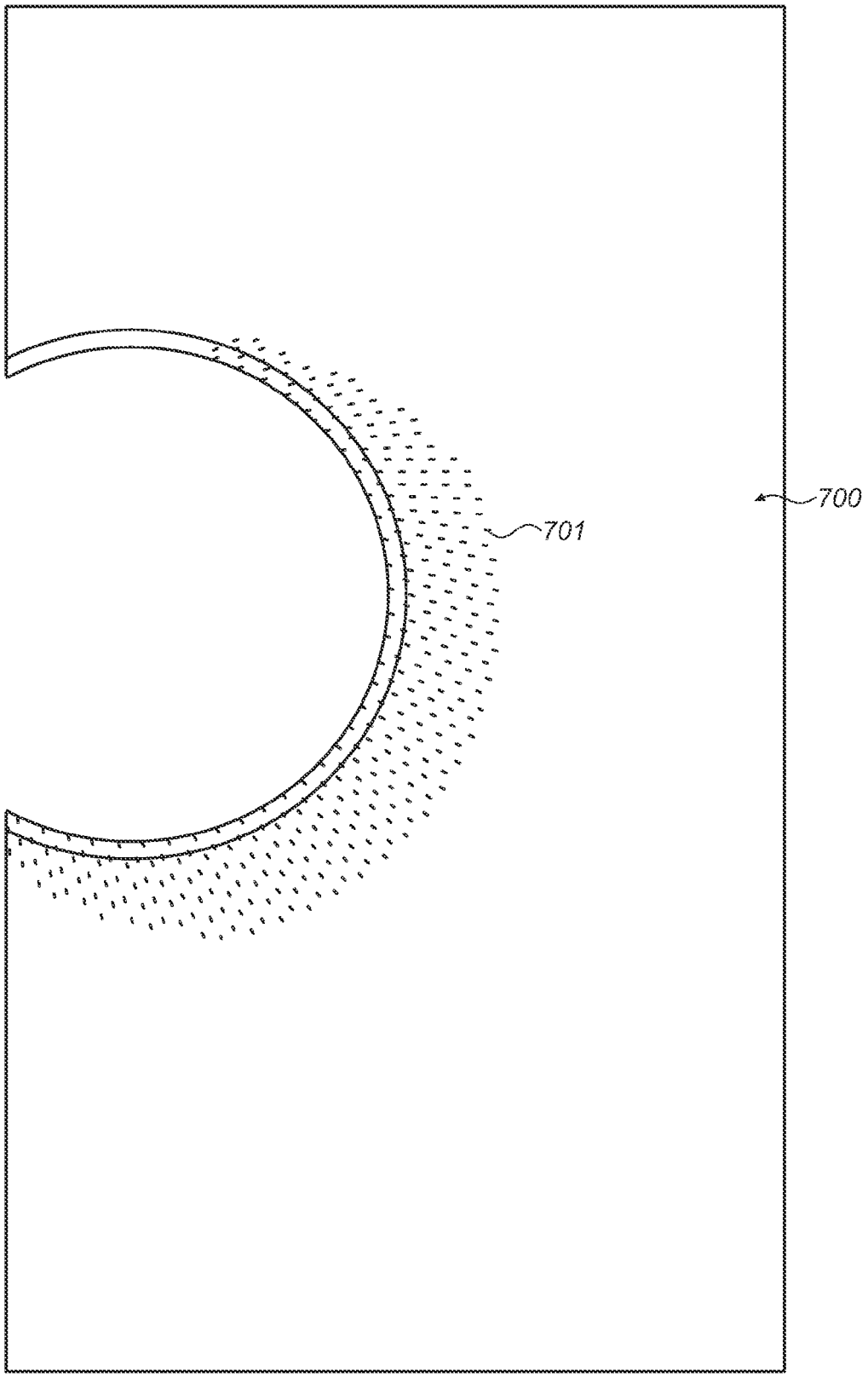
FIG. 7 provides an internal perspective view of the mesh burner of FIG. 5, according to an embodiment of the disclosed subject matter.

In the embodiment having a cylindrical mesh burner, the burner 700 has a tubular configuration and a flame is positioned on the exterior of the burner during operation. The exterior of the burner is depicted through the view window in FIG. 6. The burner 700 can define a plurality of apertures 701 along with sidewalls of burner, as depicted in FIG. 7. In this embodiment, the at least one conduit 500 (FIG. 4) channels gas into the interior of the burner. The gas can exit the burner through the plurality of holes 701 or through the bottom of the burner. Once the gas exits through either the plurality of holes or the bottom of the burner, the gas interacts with the flame of the burner and combusts to produce products of combustion. The combustion of gases using a low nitrogen oxide (NOx) mesh burner is completed in a short distance to the burner exterior.

The burner can maintain a temperate of approximately 2000° F. to 2600° F. (1093° C. to 1427° C.) for a 1.5 million BTU/hr boiler. The control unit can control the temperature of the burner and the size of the flame.

The burner can include a plurality of suitable materials, including, but not limited to stainless steel, ceramic, and inter-metallic materials.

A flame rod 711 can further be provided approximate the burner, as depicted in FIG. 6. The flame rod 711 can act as a safety device that sends reflective data to the control unit when a flame is or is not detected.

The water heating system further includes an oxygen sensor 800 (FIG. 2) coupled to the combustion chamber. Amongst other things, the oxygen sensor can detect an amount of oxygen in the products of combustion. The oxygen sensor can send and receive data. As such, the oxygen sensor can output the amount of oxygen in the combustion of gas to another device. The control unit 101 can directly receive data, including the amount of oxygen, from the oxygen sensor. In other embodiments, the oxygen sensor communicates with a sensor controller 801 (not shown) which is coupled to the oxygen sensor. In one example, the sensor controller 801 can be an application-specific integrated circuit (ASIC) integrated into the body of the oxygen sensor. The sensor controller 801 can communicate directly with the control unit 101. An example of a suitable oxygen sensor includes, but is not limited to, the Bosch® LSU 4.9 wideband sensor. That particular oxygen sensor can detect the amount of oxygen in the combustion chamber in approximately 0.80 seconds. Stated another way, the response time of the oxygen sensor 800 is approximately 0.80 seconds. An example of a sensor controller includes, but is not limited to, a Bosch® Lamdatronic 1.5 ECU module.

Because the response time of the oxygen sensor 800 is very fast, the control unit 101 can use the data from the oxygen sensor to control the water heating system and additionally optimize the water heating system. The control unit can be programmed with predetermined values for desired oxygen levels in the combustion of gas and combustion behavior. The control unit can compare the data from the oxygen sensor with given predetermined desired values to determine whether the level of oxygen in the products of combustion is suitable for the water heating system. If the data from the oxygen sensor is outside the acceptable range in comparison with the predetermined desired values, the control unit can alter the control of the water heating system to create a more suitable level of oxygen in the products of combustion. Further, the control unit can use data from other monitoring systems of the water heating system to further optimize the water heating system, such as, but not limited to, the temperature of the water heated by the products of combustion.

In one embodiment, the control unit 101 can control the rate at which the blower device 600 forces gas into the combustion chamber to alter the level of oxygen in the combustion of gas, based on the data obtained by the oxygen sensor. In another embodiment, the control unit can control the composition of the gas or the air-to-gas ratio to alter the level of oxygen in the products of combustion, based on the data obtained by the oxygen sensor. Based on the oxygen sensor data, the control unit can further fine tune the air-to-gas ratio by controlling the blower device to vary the rate at which the gas enters the combustion chamber. In a further embodiment, the control unit can control the flame of the burner to alter the level of oxygen in the products of combustion. The control unit can additionally manipulate a plurality of other variables in the water heating system to control the level of oxygen in the products of combustion.

Figure 9:
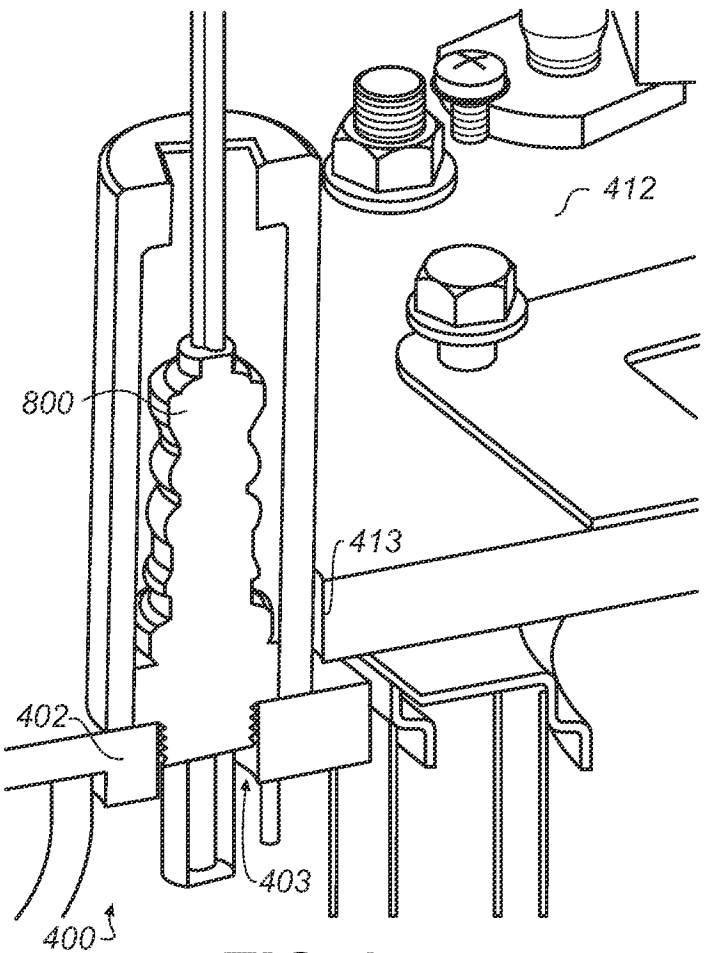
FIG. 9 provide a perspective view of the top of a water heating system, according to an embodiment of the disclosed subject matter.
Figure 8:
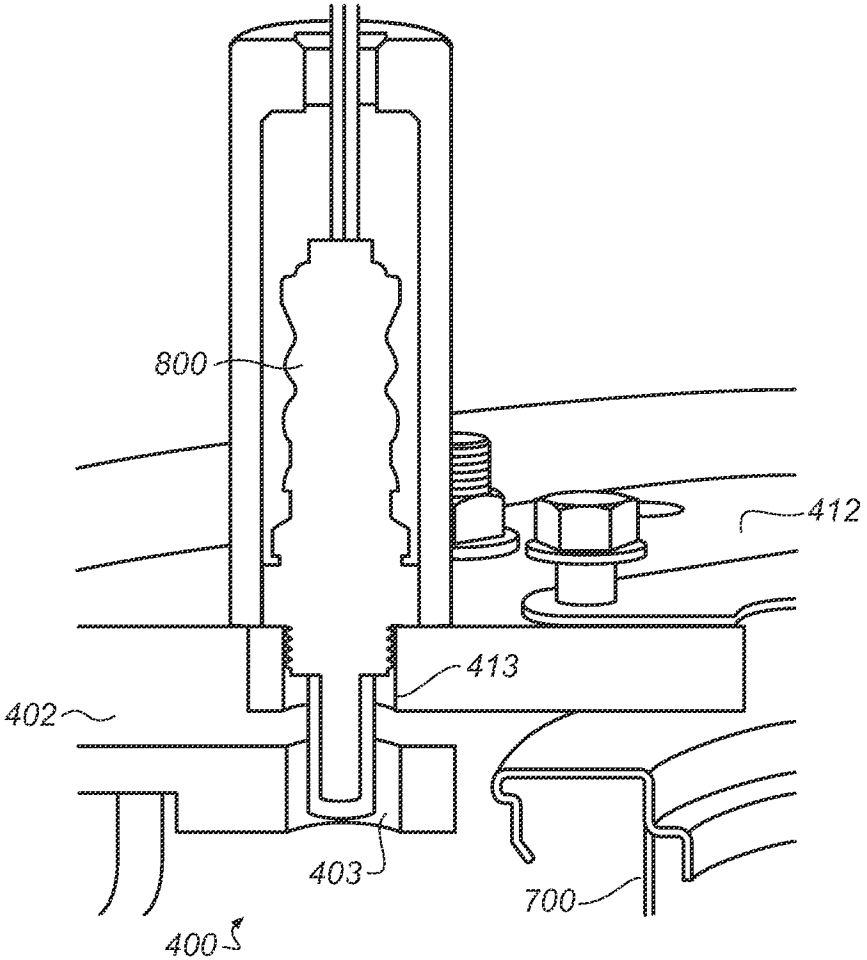
FIG. 8 provides a perspective view of the top of a water heating system, according to an embodiment of the disclosed subject matter.

The oxygen sensor can be located within the combustion chamber at a plurality of suitable locations, including, but not limited to, on the first plate 402, the top plate 412, and on the sidewall 406, as provided in FIG. 2, FIG. 8, and FIG. 9. In one embodiment, the oxygen sensor is positioned through coaxial recesses 403, 413 in the top plate and the first plate of the combustion chamber, respectively. In such embodiment, the oxygen sensor 800 can be mounted on the top plate 412 and an end of the oxygen sensor (the "sensing element" of the oxygen sensor) is positioned within the recess 403 of the first plate, as provided in FIG. 8. The end of the oxygen sensor 800 is exposed to the combustion of gases in the recess 413 by virtue of recirculation of the combustion of gas in the combustion chamber. The end of the oxygen sensor can be flush with the exterior surface of the first plate 402. As such, the end of the oxygen sensor is slightly recessed within the first plate and the end of the oxygen sensor is protectable by the recess in the first plate.

In another embodiment, the end of the oxygen sensor extends past the exterior surface of the first plate, as provided in FIG. 13. In such embodiment, the oxygen sensor creates an obstruction within the path of the combustion of gases and is in direct contact with the moving combustion of gases as depicted in FIG. 9. Further, in this embodiment, the oxygen sensor is positioned directly in a recess of the first plate and is mounted directly on to the first plate, as provided in FIG. 9.

Figure 10:
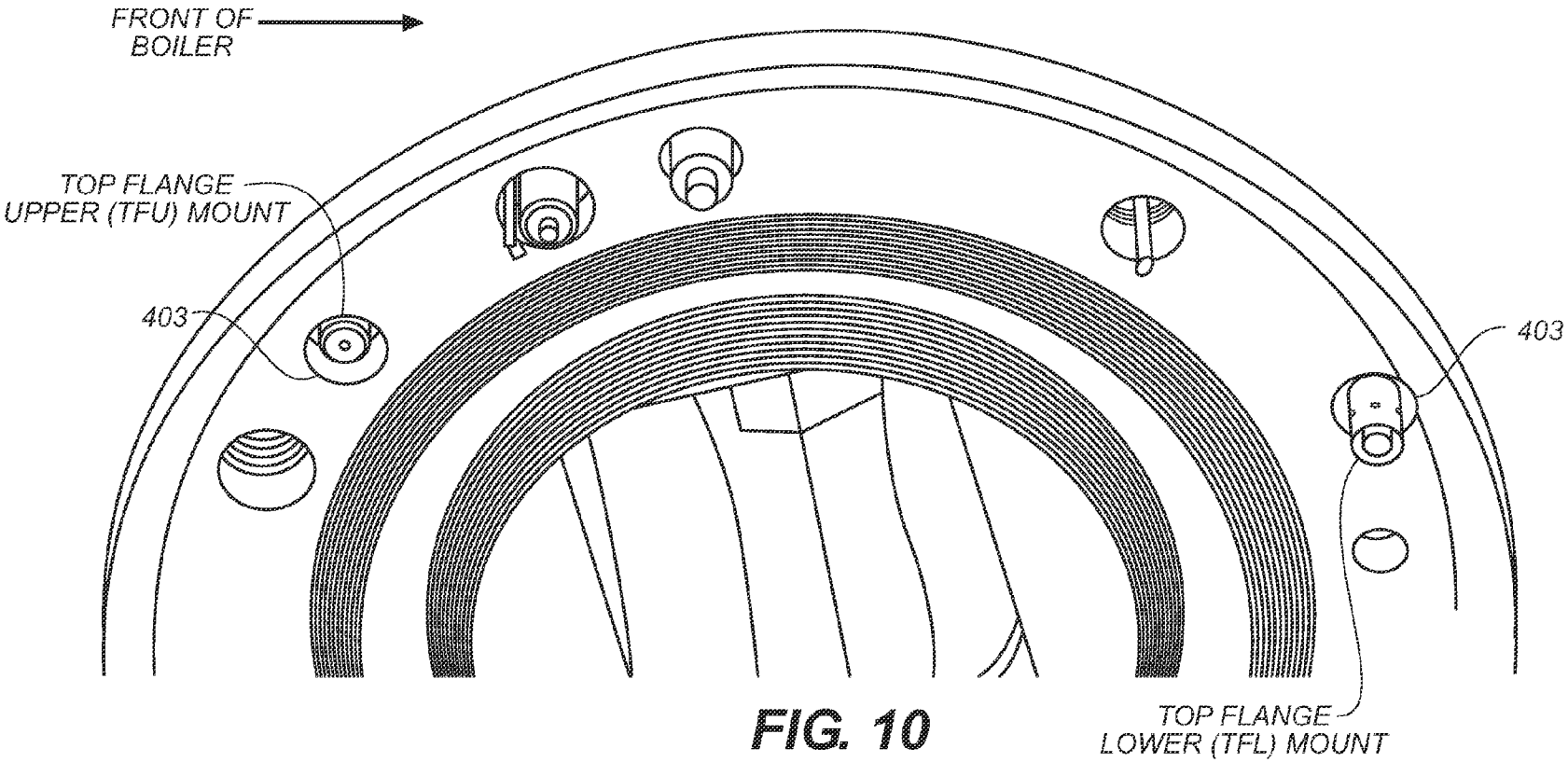
FIG. 10 provides a view from inside the combustion chamber looking into the at least one conduit, according to an embodiment of the disclosed subject matter.

FIG. 10 provides a view from inside the combustion chamber looking into the at least one conduit 500. The ends of the sensors 800 as shown in FIGS. 8 and 9 are depicted in FIG. 10. In further embodiments, the oxygen sensor is positioned through a recess on the sidewall of the combustion chamber, as depicted in the locations X and Y of FIG. 2.

Figure 11:
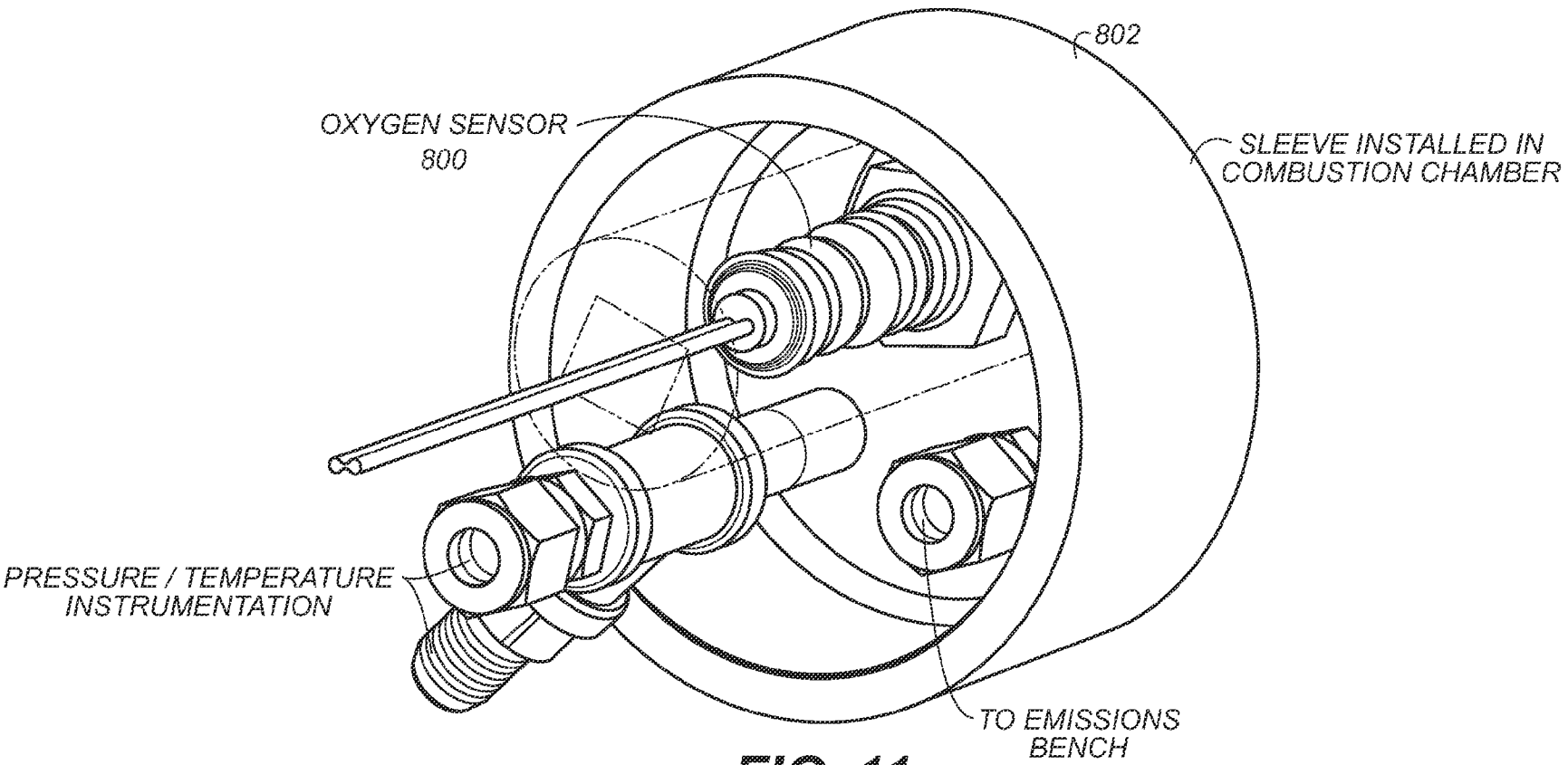
FIG. 11 provides a perspective view of an oxygen sensor in a sleeve, according to an embodiment of the disclosed subject matter.

The oxygen sensor can further be positioned in a sleeve 802 that is insertable into the combustion chamber, as depicted in FIG. 2 and FIG. 11. The sleeve further protects the oxygen sensor within the combustion chamber.

In any of the above embodiments, the oxygen sensor can be positioned such that the oxygen sensor is approximate the burner. The combustion of the gases can occur at the flame of the burner and the oxygen sensor can obtain an accurate reading at a location approximate the burner.

The oxygen sensor can include a plurality of configurations to obtain an accurate reading of the oxygen levels in the combustion chamber. The oxygen sensor can comprise zirconia, zirconium oxide, electrochemical (Galvanic), infrared, ultrasonic, chemical cell, and/or laser-centered sensors. In the embodiment with a Bosch® LSU 4.9 wideband sensor, the oxygen sensor is designed to measure the oxygen content and the Lambda value of the combustion of gas in the combustion chamber. The sensor is a planar $Zr0_2$ dual cell limited current sensor with integrated heater. Its monotonic output signal in the range of X=0.65 to air makes the sensor capable of being used as a universal sensor for X=1 measurement as well as for other Lambda ranges. The sensor is coupled to a connector module that contains a trimming resistor. The sensor operates more accurately having an internal temperature of approximately 950° F. to 1400° F. (510° C. to 760° C.). Generally, the sensor is unable to detect the oxygen readings below an internal temperature of approximately 800° F. (423° C.). The sensor can measure the resistance changes of the zirconium oxide as exposed to various oxygen levels. The sensor can have a long operating life of approximately 10 years.

The water heating system 100 further includes a heat exchanger system 900 coupled to the combustion chamber. The combustion of gases exit the combustion chamber and are provided to heat water in the heat exchanger system. Once the water is heated to a predetermined temperature, the water can exit the water heating system via an exit conduit 930. The heat exchange system can include different suitable configurations, as provided in FIG. 12 and FIG. 13. For example, the heat exchanger system can include fire tubes or alternately water tubes as known in the art.

The water heating system 100 further includes at least one flue 950 coupled to the heat exchanger system 900 to channel the products of combustion out of the heat exchanger system. The flue can be positioned at a variety of locations, as provided in FIG. 12 and FIG. 13.

A method of controlling the water heating system as described above is further provided. As depicted in the embodiment of FIG. 12, a method of controlling a water heating system includes channeling gas through at least one conduit fluidly coupled to a combustion chamber of a boiler and combusting the gas with a burner housed inside the combustion chamber. An amount of oxygen in the combustion of gas is determined by an oxygen sensor coupled to the combustion chamber and positioned within the combustion chamber adjacent the burner. Data representative of the amount of oxygen in the products of combustion is output to a control unit of the boiler. The feedback control of the water heating system is controlled at least based on the amount of oxygen in the products of combustion. The products of combustion are directed from the combustion chamber to a heat exchanger system coupled to the combustion chamber. The products of combustion in the heat exchanger system heat water in the heat exchanger system. The products of combustion are directed out of the heat exchanger system through a flue.

TABLE 2

| Valve Position | BTU | C-More $O_2$ | NDIR $O_2$ | CO | NO*x* (3%) |
|---|---|---|---|---|---|
| 100 | 1,080,000 | 5.3 | 5.28 | 83 | 22.8 |
| 95 | 1,060,000 | 5.6 | 5.61 | 69 | 18.7 |
| 90 | 982,000 | 6.0 | 6.03 | 52 | 14.5 |
| 85 | 882,000 | 6.3 | 6.28 | 43 | 12.6 |
| 80 | 793,000 | 6.3 | 6.24 | 39 | 13.0 |
| 75 | 724,000 | 6.3 | 6.25 | 36 | 13.2 |
| 70 | 667,000 | 6.5 | 6.42 | 30 | 12.2 |
| 65 | 605,000 | 6.5 | 6.52 | 27 | 11.1 |
| 60 | 549,000 | 6.2 | 6.07 | 31 | 15.0 |
| 55 | 487,000 | 6.1 | 5.86 | 30 | 16.8 |
| 50 | 418,000 | 6.0 | 5.85 | 14 | 16.8 |
| 45 | 353,000 | 6.0 | 5.82 | 21 | 15.9 |
| 40 | 301,000 | 6.0 | 5.83 | 17 | 14.1 |
| 35 | 211,000 | 7.3 | 7.23 | 10 | 6.8 |
| 30 | 129,000 | 6.3 | 6.30 | 8 | 7.3 |
| 28 | 105,000 | 7.9 | 7.86 | 8 | 4.2 |
| 26 | 76,000 | 10.2 | 10.33 | 207 | 2.0 |
| 24 | 67,000 | 10.3 | 10.30 | 516 | 1.9 |
| 22 | 64,000 | 10.1 | 10.36 | 208 | 1.8 |

TABLE 2-continued

| Valve Position | BTU | C-More $O_2$ | NDIR $O_2$ | CO | NO*x* (3%) |
|---|---|---|---|---|---|
| 20 | 59,000 | 9.6 | 9.62 | 49 | 2.1 |
| 18 | 55,000 | 9.2 | 9.22 | 29 | 2.3 |
| 16 | 47,000 | 4.6 | 4.49 | 21 | 5.6 |

The water heating system according to the disclosed subject matter was tested to determine the accuracy of the oxygen sensor in the combustion chamber as compared to readings taken by an NDIR sensor positioned in the flue. In such test, the readings with the oxygen sensor positioned in the combustion chamber at the first plate were substantially similar to the readings of the NDIR sensor. Table 2 provides a table of the tests run which depict the NDIR readings ("$0_2$") as compared to the readings of the oxygen sensor in the combustion chamber ("C-More $0_2$") in accordance with the disclosed subject matter.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A water heating system comprising:

An upright boiler, including a combustion chamber, comprising an enclosed housing including a first plate at its top, and a mesh burner mounted to the first plate, said burner housed inside the combustion chamber;

at least one conduit fluidly coupled to the combustion chamber to channel gas into the combustion chamber, wherein the burner causes combustion of gas to produce products of combustion;

an oxygen sensor coupled to a top plate of the combustion chamber and positioned within the combustion chamber to detect an amount of oxygen in the products of combustion, wherein the oxygen sensor outputs data representative of the amount of oxygen in the products of combustion;

a control unit for feedback control of the water heating system, wherein the control unit receives the data from the oxygen sensor and wherein the combustion of the gas in the combustion chamber is controllable by the control unit based on the data;

a heat exchanger system coupled to the combustion chamber to heat water in the heat exchanger system with the products of combustion, the heat exchanger system positioned below the combustion chamber and comprising a plurality of substantially straight vertical tubes through which the products of combustion flow;

at least one flue coupled to the heat exchanger system to channel the products of combustion out of the heat exchanger system;

wherein the top plate is mounted to and positioned on the first plate;

wherein the top plate and the first plate define a recess, a surface of the recess within said combustion chamber defined by the first plate, the oxygen sensor positioned with the recess and a sensing element of the oxygen sensor is entirely within the recess.

2. The water heating system according to claim 1, wherein the oxygen sensor is positioned adjacent the burner in the combustion chamber.

3. The water heating system according to claim 1, wherein the burner is coupled to the first plate and comprises a cylindrical short flame low nitrogen oxide (NOx) mesh burner.

4. The water heating system according to claim 3, wherein the first plate defines a recess that fluidly couples the at least one conduit with the combustion chamber, wherein the gas travels into an interior of the cylindrical short flame low nitrogen oxide (NOx) mesh burner via the recess from the at least one conduit.

5. The water heating system according to claim 1, wherein the boiler further comprises a water jacket and an external housing that houses the combustion chamber, wherein the water jacket is positioned between the external housing and the combustion chamber.

6. The water heating system according to claim 1, wherein the boiler further includes a blower device to blow the gas into the combustion chamber.

7. The water heating system according to claim 6, wherein the control unit controls the blower device to alter or maintain the rate of gas into the combustion chamber based on the data from the oxygen sensor.

8. The water heating system according to claim 1, wherein the gas comprises a mixture of components and the control unit varies a ratio of the components of the gas based on the data from the oxygen sensor.

9. The water heating system according to claim 1, wherein the control unit compares the data from the oxygen sensor with a predetermined value for feedback control of the water heating system.

10. The water heating system according to claim 1, wherein the heat exchanger system comprises a fire tube.

11. A method for controlling a water heating system, comprising the steps of:

Providing an upright boiler, including a combustion chamber, comprising an enclosed housing including a first plate at its top, and a mesh burner mounted to the first plate, said burner housing side the combustion chamber, at least one conduit fluidly coupled to the combustion chamber to channel gas into the combustion chamber, wherein the burner causes combustion of gas to produce products of combustion, an oxygen sensor coupled to a top plate of the combustion chamber and positioned within the combustion chamber to detect an amount of oxygen in the products of combustion, wherein the oxygen sensor outputs data representative of the amount of oxygen in the products of combustion, a control unit for feedback control of the water heating system, wherein the control unit receives the data from the oxygen sensor and wherein the combustion of the gas in the combustion chamber is controllable by the control unit based on the data, a heat exchanger system coupled the combustion chamber to heat water in the heat exchanger system with products of combustion, the heat exchanger system positioned below the combustion chamber and comprising a plurality of substantially straight vertical tubes through which the products of combustion flow, wherein the top plate is mounted to and positioned on the first plate, wherein the top plate and the first plate define a recess, a surface of the recess within said combustion chamber defined by the first plate, the oxygen sensor positioned within the recess and the sensing element of the oxygen sensor is entirely within the recess;

channeling gas through at least one conduit fluidly coupled to a combustion chamber of a boiler;

combusting the gas with a burner housed inside the combustion chamber to produce products of combustion;

sensing an amount of oxygen in the products of combustion with an oxygen sensor coupled to the combustion chamber;

outputting data representative of the amount of oxygen in the products of combustion to a control unit of the water heating system;

controlling feedback control of the water heating system at least responsive to the data from the oxygen sensor;

directing the products of combustion from the combustion chamber to a heat exchanger system coupled to the combustion chamber;

heating water with the products of combustion in the heat exchanger system; and directed the products of combustion out of the heat exchanger system through a flue.

12. The method of claim 11, wherein the steps of sensing an amount of oxygen in the products of combustion and outputting data representative of the amount of oxygen in the products of combustion occur in a time period of less than 1 second.

* * * * *

UNITED STATES PATENT AND TRADEMARK OFFICE

CERTIFICATE OF CORRECTION

PATENT NO. : 9,175,853 B2
APPLICATION NO. : 13/409935
DATED : November 3, 2015
INVENTOR(S) : Gerald A. Fioriti et al.

It is certified that error appears in the above-identified patent and that said Letters Patent is hereby corrected as shown below:

In The Claims

At column 10, claim number 11, line number 41, delete the word "directed" and replace with --directing--.

Signed and Sealed this
Tenth Day of May, 2016

Michelle K. Lee

Michelle K. Lee
*Director of the United States Patent and Trademark Office*